US006634546B2

(12) United States Patent
Heeley et al.

(10) Patent No.: US 6,634,546 B2
(45) Date of Patent: Oct. 21, 2003

(54) PACKAGE FOR FOOD PRODUCTS, BLANK OF A PACKAGE FOR FOOD PRODUCTS AND METHOD OF MANUFACTURING SUCH A BLANK

(75) Inventors: John Heeley, Munich (DE); Alain Kowalewski, Strasbourg (FR); Luigi Tettamanti, Como (IT)

(73) Assignee: Kraft Foods R&D Inc., Munich (DE)

( * ) Notice: Subject to any disclaimer, the term of this patent is extended or adjusted under 35 U.S.C. 154(b) by 0 days.

(21) Appl. No.: 09/829,836

(22) Filed: Apr. 10, 2001

(65) Prior Publication Data

US 2002/0066778 A1 Jun. 6, 2002

(30) Foreign Application Priority Data

Apr. 11, 2000 (EP) ..... 00107169

(51) Int. Cl.[7] ..... B65D 17/28; B65D 5/60

(52) U.S. Cl. ..... 229/222; 229/117.31; 229/162.6; 229/162.7; 229/164.2

(58) Field of Search ..... 229/87.05, 117.31, 229/162, 164.1, 164.2, 203, 207, 206, 222, 162.6, 162.7; 493/63, 93, 95, 96, 99

(56) References Cited

U.S. PATENT DOCUMENTS 2,820,585 A * 1/1958 Nerenberg et al. ..... 229/117.31
2,894,674 A * 7/1959 Wagaman ..... 229/222
3,580,466 A * 5/1971 Thelen ..... 229/117.31
3,580,483 A * 5/1971 Young ..... 229/222
3,640,447 A * 2/1972 Forbes, Jr. et al. ..... 229/162
3,790,744 A * 2/1974 Bowen ..... 229/87.05
3,951,333 A * 4/1976 Forbes, Jr. et al. ..... 229/207
4,565,315 A * 1/1986 Wagner et al. ..... 229/117.31
6,062,467 A * 5/2000 Ours et al. ..... 229/117.31
6,145,736 A * 11/2000 Ours et al. ..... 229/117.31

FOREIGN PATENT DOCUMENTS

DE 81 24 502 U 2/1982
EP 0 321 762 A 6/1989

OTHER PUBLICATIONS

European Search Report, for European Patent Application No. 00107169.5–2308, 1 page; Annex to the European Search Report, 1 page; and cover sheet, dated Sep. 22, 2000.

* cited by examiner

*Primary Examiner*—Gary E. Elkins
(74) *Attorney, Agent, or Firm*—Fitch, Even, Tabin, & Flannery

(57) ABSTRACT

A package and a corresponding blank (10) for a package for food products comprises a carton with at least one dividing line (24), which can be broken, and a film with a dividing line (26) or an edge allowing easy separation of the film, wherein the dividing line (24) of the carton and the dividing line (26) or the edge of the film are offset relative to each other, and the film is attached to the carton at least in the area between the dividing line (24) of the carton and the dividing line (26) or the edge of the film. In the corresponding method of manufacturing the blank, the dividing line is formed in a carton, a film is attached to the carton at least in the surroundings of the dividing line formed in the carton, and a dividing line or an edge is formed in the film such that an area in which the film is attached to the carton is formed between the dividing line of the carton and the dividing line or the edge of the film.

1 Claim, 2 Drawing Sheets

PACKAGE FOR FOOD PRODUCTS, BLANK OF A PACKAGE FOR FOOD PRODUCTS AND METHOD OF MANUFACTURING SUCH A BLANK

FIELD OF THE INVENTION

The invention relates to a package for food products, a blank for a package for food products as well as a method of manufacturing such a blank.

Packages containing food products have to fulfill various requirements. Firstly, the content of the package must be kept safely inside the package until they are to be consumed. Secondly, when it is desired to consume the product contained in the package, the package should be easy to open and preferably reclosable. Finally, it is important that any contamination of the contents of the package is prevented. In this context, the invention particularly relates to a package which is insect-proof implying that also tiny insects are not capable of entering the package.

PRIOR ART

Experiments have shown that insects, which are small enough to pass through cuts or perforations formed in a carton can enter a package made of carton. This can be effectively prevented by a package consisting of a carton, which is itself enclosed in a plastic foil which is tightly sealed. However, such a known package is comparably complex and difficult to open, because the plastic foil has to be torn, and the carton inside has to be opened in a further, separate step.

SUMMARY OF THE INVENTION

It is the object underlying the invention to provide a package for food products, which is both easy to open and insect proof implying that also tiny insects cannot reach the inside of the package. Furthermore, a blank, which is suitable for such a package and a method of manufacturing such a blank are to be provided.

These objects are according to a first aspect of the invention solved by means of the package.

Accordingly, the package comprises on the one hand a carton. The carton is formed with a dividing line which can be broken so as to provide access to the inside of the carton. On the other hand, the package comprises a film which will in most embodiments fully enclose the content of the package and, therefore, also has a dividing line allowing easy separation of the film. In order to prevent insects from entering the package, the dividing line of the carton and the dividing line of the film are offset relative to each other, and the film is attached to the carton at least in the area between the dividing line of the carton and the dividing line of the film. However, it might be sufficient to apply the film to the carton merely in the surroundings of any dividing lines, cuts or other openings of the carton. In this case, the edge of a piece of film attached to the carton corresponds to the dividing line of the film, to which reference is made above. Correspondingly, the edge of the film is also intended to be covered when reference is made to the dividing line in the following.

Due to this structure, insects are effectively prevented from entering the package due to the following reasons. As mentioned above, very tiny insects are obviously capable of passing through cuts of a perforation which could for example define the dividing line of the carton. However, once an insect has reached the inner surface of the carton, the film which is bonded to the carton—in this particular embodiment to the inside surface of the carton—prevents the insect from reaching the inside of the package. In particular, the fact that the film is firmly attached to the carton at least in the area between the dividing line of the carton and the dividing line or the edge of the film prevents the insect from reaching the dividing line of the film, which it would have to pass in order to get to the inside of the package. Preferably, the film is bonded, laminated or glued to the carton in the entire area between the dividing line of the carton and the dividing line of the film in order to achieve the above-mentioned effect.

The explanations above were given with regard to an embodiment, in which the film is attached on the inside surface of the package. Similarly, the film could be attached to the outside of the package. Also in this case, any insects, which might be capable of passing through the cuts formed in the film in order to define a dividing line, will be prevented from advancing further, because that portion of the film, which is located between the dividing line of the film and the dividing line of the carton is attached to the carton so as to prevent the insect from reaching the dividing line formed in the carton, which the insect would have to pass through in order to reach the inside of the package. It should additionally be mentioned that the easy-opening characteristic of the package is also maintained. According to the invention, the dividing lines of the film and of the carton respectively are offset relative to each other. However, this offset can be formed small enough so as to allow both dividing lines to be broken with a single action. In other words, when the dividing line of the carton is broken during opening of the package, the dividing line formed in the film will also be broken, and the package can be opened with little effort.

Preferred embodiments of the inventive package are described in the further claims.

With regard to the amount of offset between the dividing lines of the carton and of the film respectively, an offset of 2 mm to 4 mm has proved to be effective for both preventing insects from entering the package and maintaining the easy-opening characteristics of the package. That is, the described offset as well as the corresponding surface area, at which the film is attached to the carton, can effectively prevent insects from reaching the further dividing line, after they have passed through the dividing line formed in the outer element of the package. Furthermore, the mentioned amount of offset does not hinder the opening of the carton.

With regard to an attractive outer appearance of the inventive package, and in view of preferred manufacturing procedures, it is currently preferred that the film is attached to the inside of the package.

As regards the dividing line formed in the carton allowing separation of the carton so as to provide access to the contents of the package, it has been found advantageous to form the dividing line of the carton as a perforation line.

The dividing line of the film can efficiently be formed by laser-cutting. In particular, half-cutting of the film, that is reducing the thickness of the film along a line so as to define an easy-to-break dividing line, is preferred in this context.

With regard to the opening area of the inventive package, it provides advantages with regard to easy opening as well as the possibility of reclosing the inventive package to form a flap adjacent the dividing line of the carton.

In this context, secure sealing of the package as well as reclosability can be realized if the dividing line is covered by a tab which comprises a tearable strip and which is at least partially bonded to the flap adjacent the dividing line. Easy opening of the package can be achieved by removing the tearable strip so that the upper tab and the lower flap can be brought in a position to allow access to the packages inside. When a cut is formed in the lower flap, the upper tab can be locked by means of inserting a portion of the tab into the cut so as to reclose the carton after its first opening.

According to a second aspect of the invention, the above-stated object underlying the invention is solved by means of a blank of a package. Corresponding to the above-described structure of the inventive package, the inventive blank is characterized by the fact that a dividing line formed in the carton is offset relative to a dividing line formed in or an edge of the film, and that the film is attached to the carton at least in that area, which is located between the two dividing lines. As can be easily understood, the inventive blank allows the manufacture of the inventive package with standard folding and gluing procedures.

According to a third aspect of the invention, a method of manufacturing a blank for a package of a food product is provided. The inventive method is specified by the steps of forming a dividing line in a carton and thereafter attaching a film to the carton at least in the surroundings of the dividing line formed in the carton. Finally, a dividing line or an edge is formed in the film such that an area, in which the film is attached to the carton, is formed between the dividing lines of the carton and the film respectively. Furthermore, standard printing, cutting, perforating and creasing procedures are employed in order to produce an appropriate blank.

It should be noted that the preferred embodiments of both the inventive blank and the inventive method correspond to those features of the preferred embodiments of the inventive package, which are explained in detail above and do not have to be explained further with regard to the inventive blank and method.

BRIEF DESCRIPTION OF THE DRAWINGS

In the following, a currently preferred embodiment of the inventive package, the corresponding blank and the method of manufacturing such a blank are explained by way of example and with reference to the accompanying drawings, in which.

DETAILED EXPLANATION OF A PREFERRED EMBODIMENT OF THE INVENTION

Figure 1:
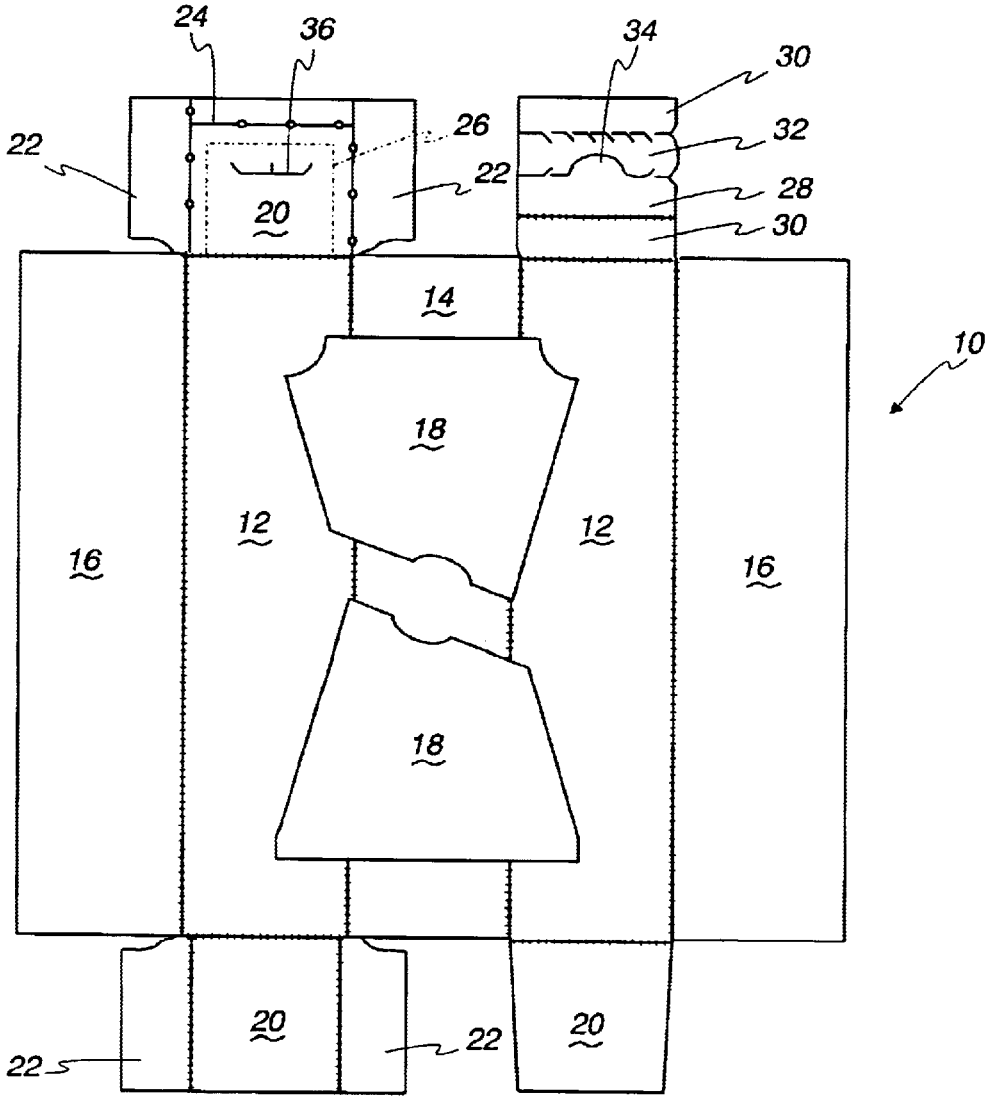
FIG. 1 shows a plan view of the blank.

As can be taken from FIG. 1, the blank 10 for a package for a food product comprises two side face portions 12, a top face portion 14 and two bottom face portions 16. In the embodiment shown in FIG. 1, two windows 18 are cut out from the blank at major portions of the top face portion 14 and the side face portions 12 so as to define three land portions at the front and the rear of the top face portion 14 as well across approximately the center of the top face portion 14 so as to define a strip of carton material between the comparably large windows at the top face. Furthermore, in the final package produced from the blank 10, shown in FIG. 1, the bottom face portions 16 are attached to each other so as to define a bottom of the package. In a generally known manner, one of the smaller side faces of the final package is defined by two flaps 20 which are bonded to each other. One of the flaps 20 comprises laterally adjacent flaps 22 which in the final package are bonded to the adjacent portion of the top and the bottom face respectively. In the final package, the side face, which is formed by those flaps 20, which are shown at the bottom of FIG. 1, is intended to remain close during use of the package.

Those flaps, which are shown at the top of FIG. 1, are formed so as to allow easy opening of the package as well as preventing insects from entering the package. With regard to their general shape, the flaps 20 of the opening side of the package are formed similar to those flaps 20 which define the closed side of the package. However, in the flap 20 shown at the upper left side of FIG. 1, which is the lower flap of the opening side of the carton, a dividing line 24 is formed. In the shown embodiment, the dividing line is shown as a solid line comprising small square-shaped markings and extends along portions of the sides of the flap 20 as well as across the flap 20. It can easily be seen that in the final package, when the side flaps 22 are bonded to the top and bottom face of the carton, an openable flap is defined by means of the dividing line 24, because the flap 20 can be separated from the adjacent top and bottom faces as well as the small strip-like remainder located above the portion defining the flap 20.

In this context, it should also be noted that a film is laminated onto that side of the carton, which forms the inside of the final package. This film—in the preferred embodiment—covers the entire carton blank as well as the windows 18 and comprises a dividing line, which is shown in a dot-and-dash pattern in FIG. 1. As can be taken from the drawing, the dividing line 26 of the film is offset relative to the dividing line 24 formed in the carton. Furthermore, the film is firmly bonded to the carton at least in the area which is defined between the dividing lines 24, 26. Also in this area, the film does not have to be bonded to the carton over the entire surface of this area. However, sufficient bonding or lamination should be formed so as to prevent insects from reaching the dividing line 26 once they have passed through the dividing line 24 of the outer carton. This feature of the inventive package efficiently prevents insects from entering the package.

Figure 3:
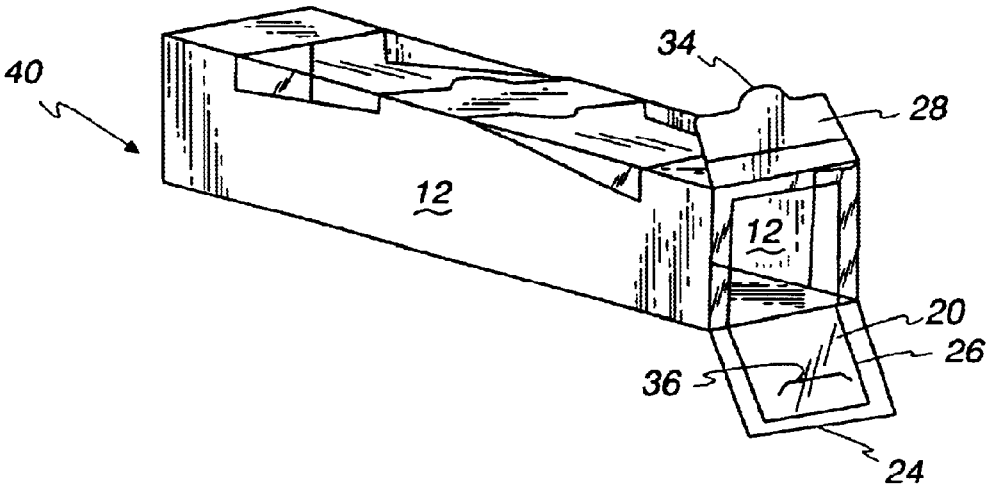
FIG. 3 shows a perspective view of the opened package.

Easy opening of the inventive insect-proof package can be realized by means of the combination of the flap 20 described above and the tab 28 shown at the right side of FIG. 1, which in the final package is arranged outside the flap 20. The tab 28 is bonded to the flap 20 preferably merely in the strip-like portions 30 formed at the bottom and the top. In between, a tearable strip 32 is defined by means of appropriate cuts in the tab 28. Once the tearable strip 32 is removed, an easy-to-grip tip 34 of the tab 28 can be grasped and moved upwards so as to initiate opening of the package, as can be seen from FIG. 3. This action exposes the flap 20 which can also be separated from the adjacent faces and folded to an open state (see FIG. 3). During this opening motion, the laminated film will be torn along the dividing line 26 which can be achieved with little effort, because the dividing line 26 is offset merely a few millimeters from the dividing line 24 of the carton formed as a perforation line.

The blank shown in FIG. 1 is manufactured as follows. As a first step, any designs, product names and consumer information are printed on that side of a carton web, which forms the outside of the package. Afterwards, the windows 18 and the perforation of the dividing line 24 are cut. At the end of a so-called first sequence, the film is laminated onto the carton. In the currently preferred embodiment, the film is laminated to the inside of the carton. In this manner, the film covers the windows 18 from the inside of the package, so that the contents are securely prevented from escaping the package before use. Thereafter, the outer shape of the blank, as it is apparent from FIG. 1, is cut from the carton web. Furthermore, the cut 36 of the flap 20 as well as adjacent branch-cuts, which allow insertion of the tip 34 of the tab 28 in the final package, are cut. In the tab 28, those cuts which define the tearable strip are formed. Finally, several crease lines are formed by means of creasing. The crease lines are shown in lines having plural adjacent short lines in FIG. 1. The crease lines basically facilitate folding of the carton in order to form the package therefrom.

During manufacture of the blank, the dividing line 26 of the laminated film is formed as a so-called half-cut. With regard to the bonding between the film and the carton, it should be noted that, particularly in the areas apart from the area between the dividing line 24 of the carton and the dividing line 26 of the film, the film does not necessarily have to be bonded to the carton over the entire surface of the carton. Rather, separate spots or lines of e.g. gluing could be sufficient. This is also the case for the area between the two dividing lines 24, 26 as long as it can be ensured that any insect, which has passed through the dividing line 24 of the carton, cannot reach the dividing line 26 of the film due to firm attachment of the film to the carton in this intermediate area.

Figure 2:
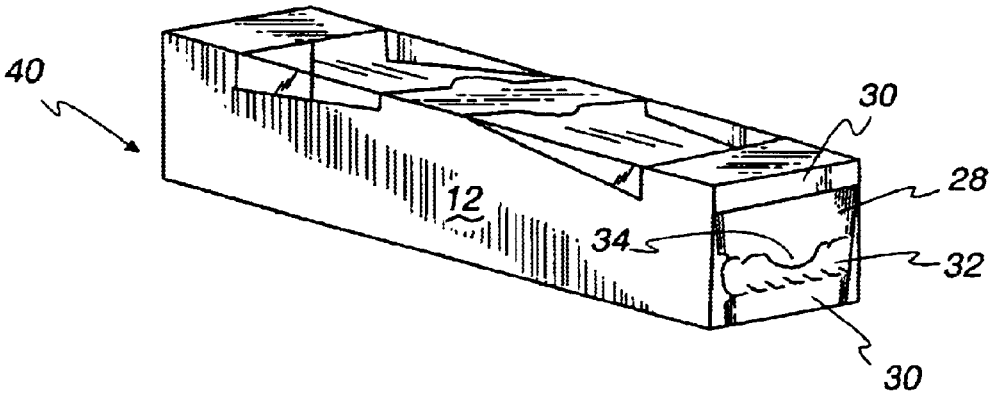
FIG. 2 shows a perspective view of the closed package.

From the blank shown in FIG. 1, the final package, as shown in FIG. 2, is formed by means of folding the blank along the crease lines and gluing the lateral flaps 22 of the closed side of the carton to the front face 14 and the bottom face 16. The other flap 20, shown at the bottom right side of FIG. 1 is glued onto the flap 20 at the bottom left side of FIG. 1. In a similar manner, at the opening side of the package the lateral flaps 22 are glued to the adjacent portions of the top face and the bottom face. Finally, the tab 28 is glued onto the flap 20 so that the opening side of the package has the appearance which is shown in FIG. 2. It should be noted that the embodiment of FIG. 2 merely differs from the embodiment of FIG. 1 in that the tab 28 is connected to the top face 14 rather than one of the side faces 12, as can be seen in FIG. 1. However, the function remains the same.

It should be noted that only the strips 30 of the tab 28 are glued to the flap 20 underneath. This allows the tearable strip 32 to be easily removed from the opening side of the package 40. The lower strip 30 remains attached to the flap 20 and can be unfolded therewith as apparent from FIG. 3. Furthermore, the portion of the tab 28 located immediately above the tearable strip 32 can be folded upwards by means of gripping the tip 34 thereof. In this manner, the upper strip 30, which is attached to the strip-like portion adjacent the dividing line 24 has the effect of removing this last-mentioned strip-like portion and opening the package along a strip-like area at the top of the opening side. This allows the consumer to insert a finger into this strip-like opening area and unfolding the flap 20 by means of removing it from the side faces 12 along the dividing line 24 and unfolding it to the position shown in FIG. 3. Thereafter, the contents of the carton can be removed. The carton is reclosable by first folding the flap 20 onto the opening of the carton and then folding the tab 28 onto the flap 20 and inserting the tip 34 of the tab 28 into the cut 36 formed in the flap 20.

We claim:

1. A package for food products comprising:

a carton with at least one dividing line which can be broken so as to provide access to the inside of the package;

a film with a dividing line allowing easy separation of the film, wherein the dividing line of the carton and the dividing line of the film are offset relative to each other for about 2 mm to about 4 mm, and the film is attached to the carton at least in the area between the dividing line of the carton and the dividing line of the film and at least in one other portion of the carton for retaining the film within the carton;

a flap formed adjacent to the dividing line of the carton;

and a tab at least partially bonded to the flap and comprising a tearable strip wherein the dividing line of the carton is covered by the tab.

* * * * *